US008668605B1

(12) United States Patent
Huang

(10) Patent No.: US 8,668,605 B1
(45) Date of Patent: Mar. 11, 2014

(54) ARROW OUTSERT

(76) Inventor: Dorge O. Huang, Henry, IL (US)

( * ) Notice: Subject to any disclaimer, the term of this patent is extended or adjusted under 35 U.S.C. 154(b) by 65 days.

(21) Appl. No.: 13/357,746

(22) Filed: Jan. 25, 2012

(51) Int. Cl.
*F42B 6/08* (2006.01)

(52) U.S. Cl.
USPC ..... 473/582

(58) Field of Classification Search
USPC ..... 473/578, 582, 583; 138/173, 177
See application file for complete search history.

(56) References Cited

U.S. PATENT DOCUMENTS

| | | | | | |
|---|---|---|---|---|---|
| 78,564 | A * | 6/1868 | Austin | 138/28 |
| 169,699 | A * | 11/1875 | Hazelton | 138/145 |
| 590,374 | A * | 9/1897 | Osburn | 174/68.3 |
| 2,099,126 | A * | 11/1937 | Larsen | 156/256 |
| 5,273,293 | A * | 12/1993 | Lekavich | 473/578 |
| 5,611,542 | A | 3/1997 | Saunders | |
| 6,595,880 | B2 * | 7/2003 | Becker | 473/578 |
| 8,267,815 | B2 * | 9/2012 | Braun et al. | 473/578 |
| 2011/0172040 | A1 * | 7/2011 | Belcik | 473/578 |
| 2011/0269582 | A1 * | 11/2011 | James | 473/578 |

* cited by examiner

*Primary Examiner* — John Ricci
(74) *Attorney, Agent, or Firm* — Donald J. Ersler

(57) ABSTRACT

An arrow outsert preferably includes a first end and a second end. An arrow point bore is formed in the first end of the arrow outsert to receive a cylindrical portion of an arrow point. An arrow shaft bore is formed in the second end of the arrow outsert to receive an arrow shaft. An outer surface of the arrow outsert is preferably tapered starting at the second end. A female thread is formed through a middle of the arrow outsert to threadably engage a threaded stud of the arrow point. A plurality of axial slots are formed in an outer perimeter of the arrow outsert. The arrow outsert is secured to an end of an arrow shaft by applying glue, adhesive or the like, before insertion into the arrow shaft bore. The threaded stud of the arrow point is threaded into the female thread to complete assembly.

17 Claims, 1 Drawing Sheet

ARROW OUTSERT

BACKGROUND OF THE INVENTION

1. Field of the Invention

The present invention relates generally to archery and more specifically to an arrow outsert, which allows an arrow to be easily removed from a penetrated object.

2. Discussion of the Prior Art

U.S. Pat. No. 5,611,542 to Saunders discloses an outsert for arrows. However, the outsert includes a central section with a decreased diameter, which makes it more difficult to remove an arrow from a penetrated object.

Accordingly, there is a clearly felt need in the art for an arrow outsert, which does not include a central section with a decreased diameter and which may be easily removed from a penetrated object.

SUMMARY OF THE INVENTION

The present invention provides an arrow outsert, which allows an arrow to be easily removed from a penetrated object. The arrow outsert preferably includes an elongated body. The elongated body includes a first end and a second end. An arrow point bore is formed in the first end of the elongated body to receive a cylindrical portion of an arrow point. An arrow shaft bore is formed in the second end of the elongated body to receive an arrow shaft. An outer surface of the arrow outsert is preferably tapered from the second end to substantially a middle of the elongated body. A female thread is formed through a middle of the arrow outsert to threadably engage a threaded stud of the arrow point.

A plurality of axial slots are formed in an outer perimeter of the arrow outsert. The plurality of axial slots preferably include an entrance slot portion, a middle slot portion and an exit slot portion. The entrance slot portion starts at the first end of the elongated body and gradually tapers inward toward a centerline of the elongated body and communicates with a first end of the middle slot portion. The middle slot portion is formed above the female thread. The exit slot portion communicates with a second end of the middle slot portion and tapers outward away from the centerline and terminates adjacent the arrow shaft bore. The exit slot portion of the axial slot helps to make the arrow easily removable from a penetrated object. The elongated body may be formed of any suitable metal or non-metal high impact material. The arrow outsert is secured to an end of an arrow shaft by applying glue, adhesive or the any other suitable substance, such as epoxy to an end of the arrow shaft and inserting the arrow shaft into the arrow shaft bore. The threaded stud of the arrow point is threaded into the female thread to complete assembly.

Accordingly, it is an object of the present invention to provide an arrow outsert, which does not include a central section with a decreased diameter.

Finally, it is another object of the present invention to provide an arrow outsert, which may be easily removed from a penetrated object.

These and additional objects, advantages, features and benefits of the present invention will become apparent from the following specification.

DETAILED DESCRIPTION OF THE PREFERRED EMBODIMENTS

Figure 1:
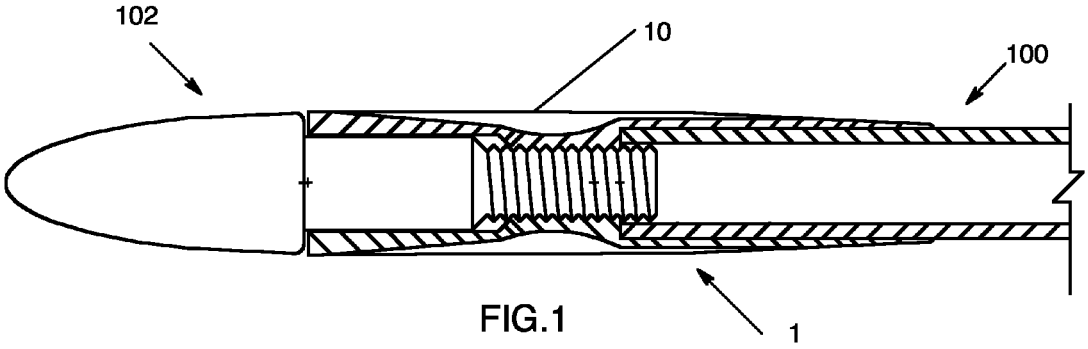
FIG. 1 is a cross sectional view of an arrow outsert attached to an arrow shaft and an arrow point secured to the arrow outsert in accordance with the present invention.
Figure 2:
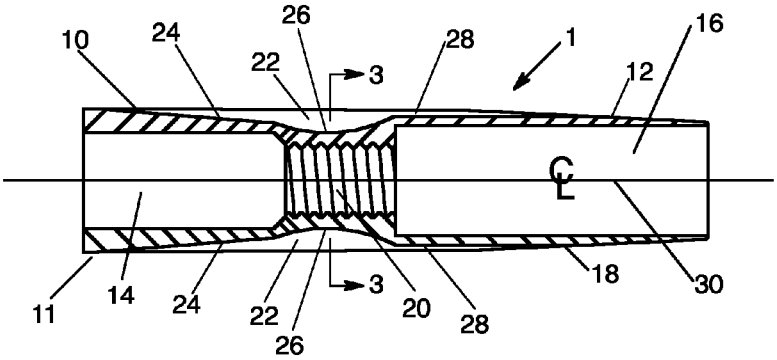
FIG. 2 is a cross sectional view of an arrow outsert in accordance with the present invention.
Figure 5:
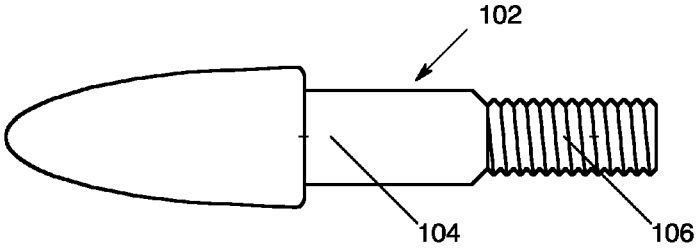
FIG. 5 is a side view of an arrow point.

With reference now to the drawings, and particularly to FIG. 1, there is shown a cross sectional view of an arrow outsert 1 attached to an arrow shaft 100 and retaining an arrow point 102. With reference to FIG. 2, the arrow outsert 1 preferably includes an elongated body 10. The elongated body 10 includes a first end 11 and a second end 12. With reference to FIG. 5, an arrow point bore 14 is formed in the first end 11 of the arrow outsert 1 to receive a cylindrical portion 104 of the arrow point 102. An arrow shaft bore 16 is formed in the second end of the elongated body 10 to receive the arrow shaft 100. The arrow shaft 100 is secured in the arrow outsert 1 by applying a glue, adhesive or any other suitable substance, such as epoxy to an end of the arrow shaft 100 and inserting the arrow shaft 100 into the arrow shaft bore 14.

A tapered surface 18 is preferably formed on an outer perimeter of the arrow outsert 1 from the second end 12 to substantially a middle of the arrow shaft bore 16. The smaller end of the tapered surface 18 starts at the second end 12. A female thread 20 is formed through an area between an end of the arrow point bore 14 and an end of the arrow shaft bore 16 The female thread 20 is sized to threadably engage a threaded stud 106 of the arrow point 102.

Figure 3:
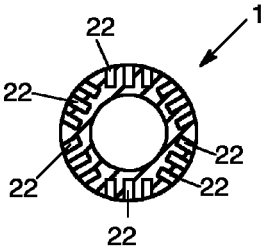
FIG. 3 is a cross sectional view of an arrow outsert cut through FIG. 2 in accordance with the present invention.
Figure 4:
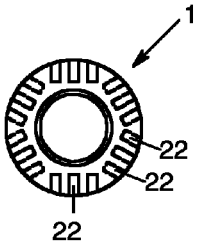
FIG. 4 is an end view of an arrow outsert taken from a first end thereof in accordance with the present invention.

With reference to FIGS. 3-4, a plurality of axial slots 22 are formed in an outer perimeter of the arrow outsert 1. The plurality of axial slots 22 preferably include an entrance slot portion 24, a middle slot portion 26 and an exit slot portion 28. The entrance slot portion 24 starts at the first end 11 of the elongated body 10 and tapers inward toward a centerline 30 of the elongated body 10. The entrance slot portion 24 communicates with a first end of the middle slot portion 28. The middle slot portion 26 is formed above the female thread 20. The middle slot portion 26 preferably has an inwardly curving shape. The exit slot portion 28 communicates with a second end of the middle slot portion 26 and tapers outward away from the centerline and terminates adjacent the arrow shaft bore. The plurality of axial slots 22 lighten the arrow outsert 1. The exit slot portion 28 helps to make the arrow easily removable from a penetrated object. The elongated body 10 may be formed of any suitable metal or non-metal high impact material.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. An arrow outsert comprising:

an elongated body having an outer perimeter, a first end and a second end, said outer perimeter includes a substantially cylindrical shape extending from said first end to said second end, an arrow point bore is formed in said first end, said arrow point bore includes a cylindrical shape, an arrow shaft bore is formed in said second end, said arrow shaft bore includes a cylindrical shape, a plurality of axial slots are formed in said outer perimeter of said elongated body; and said elongated body includes a middle, said arrow point bore includes an end that does not extend to said middle of said elongated body, said arrow shaft bore includes an end that does not extend to said middle of said elongated body.

2. The arrow outsert of claim 1 wherein:

said outer perimeter having a middle portion, said outer perimeter being tapered inward from substantially said middle portion to said second end.

3. The arrow outsert of claim 1 wherein:

at least one of said plurality of axial slots includes an entrance slot portion, a middle slot portion and an exit slot portion.

4. The arrow outsert of claim 1 wherein:

said elongated body is fabricated from one of a metal and a non-metal high impact material.

5. An arrow outsert comprising:

an elongated body having an outer perimeter, a first end and a second end, said outer perimeter includes a substantially cylindrical shape extending from said first end to said second end, an arrow point bore is formed in said first end, an arrow shaft bore is formed in said second end, means for retaining an arrow point is located between said arrow point bore and said shaft bore, a plurality of axial slots are formed in said outer perimeter of said elongated body.

6. The arrow outsert of claim 5 wherein:

said outer perimeter having a middle portion, said outer perimeter being tapered inward from substantially said middle portion to said second end.

7. The arrow outsert of claim 5 wherein:

at least one of said plurality of axial slots includes an entrance slot portion which extends from said first end to adjacent said female thread.

8. The arrow outsert of claim 5 wherein:

at least one of said plurality of axial slots includes a middle slot portion which is located over said means for retaining an arrow point.

9. The arrow outsert of claim 5 wherein:

said elongated body is fabricated from one of a metal and a non-metal high impact material.

10. The arrow outsert of claim 5 wherein:

said means for retaining an arrow point are female threads.

11. The arrow outsert of claim 5 wherein:

said plurality of axial slots taper outward from a centerline of said elongated body from said female thread to said arrow shaft bore.

12. An arrow outsert comprising:

an elongated body having an outer perimeter, a first end, a middle portion and a second end, said outer perimeter includes a substantially cylindrical shape extending from said first end to substantially said middle portion, said outer perimeter being tapered inward from substantially said middle portion to said second end, an arrow point bore is formed in said first end, an arrow shaft bore is formed in said second end, a female thread is formed between said arrow point bore and said arrow shaft bore, a plurality of axial slots are formed in an outer perimeter of said elongated body.

13. The arrow outsert of claim 12 wherein:

at least one of said plurality of axial slots includes an entrance slot portion which extends from said first end to adjacent said female thread.

14. The arrow outsert of claim 12 wherein:

at least one of said plurality of axial slots includes a middle slot portion which is located over said female thread.

15. The arrow outsert of claim 12 wherein:

at least one of said plurality of axial slots includes an exit slot portion which tapers outward from a centerline of said elongated body from said female thread to said arrow shaft bore.

16. The arrow outsert of claim 12 wherein:

said elongated body is fabricated from one of a metal and a non-metal high impact material.

17. The arrow outsert of claim 12 wherein:

one of glue and adhesive being applied to said arrow shaft before insertion into said arrow shaft bore.

* * * * *